US005672572A

United States Patent [19]

Arai et al.

[11] Patent Number: 5,672,572

[45] Date of Patent: Sep. 30, 1997

[54] LUBRICATING OIL COMPOSITION

[76] Inventors: Katsuya Arai, 4-4 Nishitsurugaoka 1-Chome, Ohi-Machi, Saitama-Ken 356; Satoshi Asano, 3-8 Negishidai 7-Chome, Asaka-Shi, Saitama-Ken 351; Sadao Wada, 21-15 Kashiwa-Mach, 6-Chome, Shiki-Shi, Saitama-Ken 353, all of Japan

[21] Appl. No.: 553,289

[22] PCT Filed: May 27, 1994

[86] PCT No.: PCT/US94/06002

§ 371 Date: Mar. 19, 1996

§ 102(e) Date: Mar. 19, 1996

[87] PCT Pub. No.: WO94/28095

PCT Pub. Date: Dec. 8, 1994

[30] Foreign Application Priority Data

May 27, 1993 [JP] Japan ..... 5-148670

[51] Int. Cl.[6] ..... C10M 141/10; C10M 141/00

[52] U.S. Cl. ..... 508/364; 508/365; 508/373; 508/374; 508/518

[58] Field of Search ..... 508/372, 373, 508/374, 363, 364, 518

[56] References Cited

U.S. PATENT DOCUMENTS

| | | | |
|---|---|---|---|
| 2,714,092 | 7/1955 | Culnane et al. | 508/518 |
| 3,493,507 | 2/1970 | Haak et al. | 508/374 |
| 3,704,315 | 11/1972 | Strang | 508/518 |
| 3,840,463 | 10/1974 | Froeschmann et al. | 508/161 |
| 4,098,705 | 7/1978 | Sakurai et al. | 508/363 |
| 4,529,526 | 7/1985 | Inoue et al. | 508/363 |
| 4,704,216 | 11/1987 | Hata et al. | 508/372 |
| 4,832,867 | 5/1989 | Seiki et al. | 508/364 |
| 4,846,983 | 7/1989 | Ward, Jr. | 508/363 |
| 5,281,347 | 1/1994 | Rgarashi et al. | 508/363 |
| 5,328,620 | 7/1994 | Ripple | 252/32.7 |
| 5,356,547 | 10/1994 | Arai et al. | 508/364 |

FOREIGN PATENT DOCUMENTS

| | | |
|---|---|---|
| 1061428 | 5/1992 | China . |
| 0113045 | 7/1984 | European Pat. Off. . |
| 0562172A1 | 9/1993 | European Pat. Off. . |
| 654669 | 3/1979 | U.S.S.R. . |
| 1049528 | 10/1983 | U.S.S.R. . |

*Primary Examiner*—Ellen M. McAvoy
*Attorney, Agent, or Firm*—Joseph J. Allocca

[57] ABSTRACT

A lubricating oil composition having a total base number of 2 to 13 and comprising (A) 0.04 to 0.12% by weight (in terms of phosphorus), based on the whole composition, of a zinc dialkyldithiophosphate, (B) 1.0 to 3.0% by weight of a calcium sulfonate (TBN 200 to 300) and 0.3 to 2.5% by weight of a calcium salicylate (TBN 10 to 100) and (C) 50 to 2,000 ppm (in terms of molybdenum) of sulfurized oxymolybdenum dithiocarbamate containing a hydrocarbyl group having 8 to 23 carbon atoms.

6 Claims, No Drawings

LUBRICATING OIL COMPOSITION

BACKGROUND OF THE INVENTION

1. Field of the Invention

The present invention relates to a novel lubricating oil composition, in particular, a lubricating oil composition having improved friction reducing properties and wear resistance and suitable for use as a lubricating oil for internal combustion engines, automatic transmissions, suspension and power steering wheels, particularly as a lubricating oil for internal combustion engines.

2. Description of the Related Art

Lubricating oils are usually used for smoothing the operation of internal combustion engines, driving mechanisms such as automatic transmissions, suspensions and power stearings, and gears. Particularly, engine oils are effective in lubricating mainly sliding parts such as a piston ring and a cylinder liner, bearings of a crank shaft or a connecting rod, and valve trains including cams and valve lifters; in cooling the engine; in cleaning and dispersing combustion products; and in preventing rust formation and corrosion.

Thus, various functions are required of the engine oils and, recently, even better functions are being demanded as the required performance and engine output become higher and higher and the operation conditions more severe. Under these circumstances, additives such as a corrosion inhibitor, metallic detergent, ashless dispersant and antioxidant are incorporated into the engine oil in order to satisfy such requirements.

It is an important basic function of an engine oil to drive the engine smoothly and to prevent wear and seizure under any given condition. In the lubricated parts of an engine, a fluid lubrication state is mostly realized. However, in the valve train and the top and the bottom dead centers of a piston, a boundary lubrication state is apt to occur. In such a boundary lubrication, wear is usually prevented by addition of zinc dithiophosphate (ZnDTP) or zinc dithiocarbamate (ZnDTC).

Since the energy loss in the friction parts in which the lubricating oil participates is high in the engine, a friction modifier (FM) is added to the lubricating oil in order to minimize the friction loss and improve the fuel consumption. As the friction modifiers, extreme-pressure additives such as molybdenum compounds and phosphoric esters and oiliness improvers such as fatty acid esters and alkylamines are usually used.

However, when a combination of the antiwear agent with the friction modifier is used, the functions of both of them are not fully exhibited because of their competitive adsorption onto the metal surface. More specifically, ZnDTP and ZnDTC protect the metal surface from wear due to metal/metal contact by forming a protective film thereon, while the friction modifier also forms a low-friction film by the adsorption onto the metal surface, by the reaction therewith or by the formation of a polymer on the metal surface to reduce the friction. Therefore, when both ZnDTP or ZnDTC and the friction modifier are added to the lubricating oil, the adsorption of ZnDTP and ZnDTC is reduced in amount by the competitive adsorption onto the metal surface to reduce the wear resistance or no sufficient friction-reducing effect can be obtained even by the addition of the friction modifier.

On the other hand, an interaction between ZnDTP or ZnDTC and some detergent-dispersant is apt to occur to reduce the wear resistance. Further, other additives such as the detergent-dispersant might exert an influence on the effect of the friction modifier. Thus, the selection of other additives such as the detergent-dispersant and the concentration thereof must be taken into consideration.

The present invention has been completed after investigations made for the purpose of providing a lubricating oil composition having improved friction reduction and antiwear properties and suitable for use as a lubricating oil for internal combustion engines, automatic transmissions, suspension and power steering wheels, particularly as a lubricating oil for internal combustion engines.

SUMMARY OF THE INVENTION

After intensive investigations made for the purpose of developing a lubricating oil composition having the above-described excellent properties, the inventors have found that the above purpose can be attained with a lubricating oil composition comprising zinc dialkyl dithiophosphates, mainly one having secondary alkyl groups, a calcium sulfonate and a calcium salicylate as a metallic detergent and sulfurized oxymolybdenum dithiocarbamate in specified proportions. The present invention has been completed on the basis of this finding.

Specifically, the present invention provides a lubricating oil composition comprising a base oil containing (A) from 0.04 to 0.12% by weight (in terms of phosphorus), based on the whole composition, of a zinc dialkyl dithiophosphate containing 50 to 100% by weight (in terms of phosphorus), based on the total phosphorus content, of a zinc dialkyl dithiophosphate having secondary alkyl groups and 50 to 0% by weight tin terms of phosphorus), based on the total phosphorus content, of a zinc dialkyl dithiophosphate having primary alkyl groups, (B) 1.0 to 3.0% by weight of a calcium sulfonate and 0.3 to 2.5% by weight of a calcium salicylate, and (C) 50 to 2,000 ppm (in terms of molybdenum) of a sulfurized oxymolybdenum dithiocarbamate containing at least one hydrocarbon group having 8 to 23 carbon atoms, wherein the oil composition is characterized by having a total base number of 2 to 13.

DETAILED DESCRIPTION OF THE INVENTION

The base oil usable as the major component in the lubricating oil composition of the present invention is not particularly limited. Base oils are those usually used in ordinary lubricating oils, such as mineral oils and synthetic oils.

The mineral oils include, for example, 60 neutral oil, 100 neutral oil, 150 neutral oil, 300 neutral oil and 500 neutral oil obtained by solvent refining or hydrotreating; and low pour point base oils prepared by removing a wax from these base oils so as to improve the low-temperature fluidity. They may be used either singly or in the form of a mixture of two or more of them in a proper ratio.

The synthetic oils include, for example, poly-α-olefin oligomers, diesters, polyol esters and polyglycol esters. They are usable either singly or in the form of a mixture. They are also usable in the form of a mixture with the above-described mineral oil. The mixing weight ratio of the synthetic oil to the mineral oil is, for example, 80:20 to 20:80.

A suitable base oil usable in the composition of the present invention is one having a viscosity in the range of 3 to 20 cSt at 100° C. Particularly preferred are hydrocracked products and/or wax isomerized product containing 3.0% by weight or below of an aromatic component and having a sulfur content of 50 ppm or below and a nitrogen content of 50 ppm or below.

In the composition of the present invention, the component (A) is zinc dialkyl dithiophosphate (ZnDTP). ZnDTP comprises ZnDTP having secondary alkyl groups and ZnDTP having primary alkyl groups in such a proportion that the content of the phosphorus therein is 50 to 100% by weight and 50 to 0% by weight, respectively, based on the total phosphorus content. By using such a ZnDTP, the object of the present invention can be effectively attained.

The ZnDTP having secondary alkyl groups include those of the following general formula:

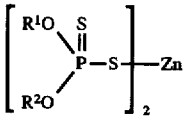

[1]

The groups $R^1$ and $R^2$ in the general formula [1] each represent a secondary alkyl group having 3 to 25 carbon atoms, such as propyl, butyl, pentyl, hexyl, cyclohexyl, octyl, decyl, dodecyl, pentadecyl or octadecyl group. They may be the same or different.

On the other hand, the ZnDTP having primary alkyl groups include, for example, those of the following general formula:

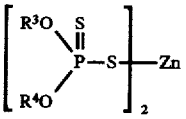

[2]

The groups $R^3$ and $R^4$ in the general formula [2] each represent a primary alkyl group having 8 to 25 carbon atoms, such as octyl, decyl, lauryl, myristyl, palmityl, stearyl or eicosyl group. They may be the same or different.

In the composition of the present invention, the amount of ZnDTP used as the component (A) must be 0.04 to 0.12% by weight (in terms of phosphorus) based on the whole composition. When the amount of phosphorus is below 0.05% by weight, the wear resistance is insufficient and, when it is above 0.12% by weight, there is no further significant improvement in wear resistance.

The composition of the present invention contains a calcium sulfonate and a calcium salicylate as the metallic detergent (B). The amount of the calcium sulfonate must be 1.0 to 3.0% by weight based on the whole composition. When the amount of calcium sulfonate is below 1.0% by weight, the detergency is insufficient and when it is above 3.0% by weight, the detergency effect is not further increased and the ash content is increased unfavorably. On the other hand, the calcium salicylate must be contained in an amount of 0.3 to 2.5% by weight based on the whole composition. When it is below 0.3% by weight, no sufficient friction reducing properties can be obtained and, when it exceeds 2.5% by weight, the wear resistance is reduced and the ash content is increased unfavorably.

The calcium salicylates are, for example, those of the following general formula:

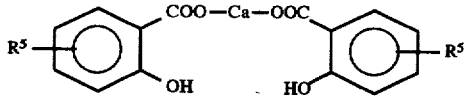

[3]

In the general formula [3], $R^5$ represents a linear, branched or cyclic alkyl group having 8 to 23 carbon atoms, such as octyl, nonyl, decyl, dodecyl, pentadecyl, octadecyl or eicosyl group.

A sulfurized oxymolybdenum dithiocarbamate (MoDTC) having a hydrocarbon group having 8 to 23 carbon atoms is contained as the component (C) in the composition of the present invention. MoDTC has a structure of the following general formula:

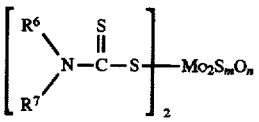

[4]

The groups $R^6$ and $R^7$ in the above general formula [4] each represent a hydrocarbon group having 8 to 23 carbon atoms. The hydrocarbon groups having 8 to 23 carbon atoms include linear and branched alkyl and alkenyl groups having 8 to 23 carbon atoms, and cycloalkyl, aryl alkylaryl and arylalkyl groups having 8 to 23 carbon atoms. Examples of them include 2-ethyl-hexyl, n-octyl, nonyl, decyl, lauryl, tridecyl, palmityl, stearyl, oleyl, eicosyl, butylphenyl and nonylphenyl groups. $R^6$ and $R^7$ may be the same or different, and m and n are positive integers such that the sum of them is 4.

In the composition of the present invention, MoDTC used as the component (C) may be used either singly or in combination of two or more of them. The amount of MoDTC is in the range of 50 to 2,000 ppm (in terms of molybdenum), preferably 100 to 1,000 ppm, based on the whole composition. When the amount of molybdenum is below 50 ppm, no sufficient low-frictional properties can be obtained and when it is above 2,000 ppm, the frictional properties are not further significantly improved.

The total base number of the composition of the present invention must be 2 to 13, preferably 4 to 9. The base number is determined according to JIS K 2501 (the unit of the total base number being mgKOH/g).

The total base number of the composition of the present invention can be suitably controlled with a calcium sulfonate having a total base number (TBN) of 200 to 300 or a calcium sulfonate having a total base number (TBN) of 10 to 100.

The lubricating oil composition of the present invention may contain suitable additives usually incorporated into lubricating oils, such as an ashless detergent-dispersant, viscosity index improver, pour point depressant, antioxidant, rust inhibitor, corrosion inhibitor, antifoaming agent and other antiwear agent and friction modifier, so far as the object of the present invention is not disturbed thereby.

The ashless detergent-dispersant include, for example, succinimides, succinamides, benzylamines and their boron derivatives and esters. They are used in an amount of usually 0.5 to 7% by weight, based on the whole composition.

The viscosity index improvers include, for example, polymethacrylates, polyisobutylenes, ethylene/propylene copolymers and hydrogenated styrene/butadiene copolymers. They are used in an amount of usually 0.5 to 35% by weight, based on the whole composition. The antioxidants include, for example, amine antioxidants such as alkylated diphenylamines, phenyl-α-naphthylamines and alkylated α-naphthylamines, and phenolic antioxidants such as 2,6-di-t-butyl-4-methylphenol and 4,4'-methylenebis(2,6-di-t-butylphenol). They are used in an amount of usually 0.05 to 2% by weight, based on the whole composition.

The rust inhibitors include, for example, alkenylsuccinic acids and partial esters thereof. The corrosion inhibitors include, for example, benzotriazole and benzimidazole. The antifoaming agents include, for example, dimethylpolysiloxanes and polyacrylates. They can be suitably incorporated into the composition.

The following Examples will further illustrate the present invention and do not limit the invention.

EXAMPLES 1 to 8 and Comparative Examples 1 to 10

The coefficient of friction and wear track diameter of the lubricating oil composition were determined as follows:

(1) Coefficient of friction (μ):

The efficient of friction was determined by the LFW-1 test under the conditions of 270 rpm, 30 kgf, 120° C. and 10 minutes.

(2) Wear track diameter (mm):

The wear track diameter was determined by the Shell four-ball friction test under the conditions of 1,800 rpm, 20 kgf, 90° C. and 30 minutes.

Base oil 150N-1 (having viscosity at 100° C. of 5.7 $mm^2/s$, aromatic component content of 4.1 wt %, sulfur content of 11.0 ppm and nitrogen content of 89.0 ppm) or 150N-2 (having viscosity at 100° C. of 5.5 $mm^2/s$, aromatic component content of 0.5 wt %, sulfur content of 0.5 ppm and nitrogen content of 0.1 ppm) was used.

Each of the lubricating oil compositions listed in Table 1 was prepared from the base oil, and the coefficient of friction (μ) and the wear track diameter (mm) were determined. The results are given in Tables 1-1 and 1-2.

TABLE 1-1

| | | Example 1 | Example 2 | Example 3 | Example 4 | Example 5 | Example 6 | Example 7 | Example 8 |
|---|---|---|---|---|---|---|---|---|---|
| Component (wt %) | Base Oil 150N-1 | balance | balance | balance | balance | balance | balance | balance | — |
| | Base Oil 150N-2 | — | — | — | — | — | — | — | balance |
| | Sec. $C_3C_6$-ZnDTP | 1.0 | 0.6 | 0.6 | 0.9 | 1.0 | 1.0 | 0.6 | 1.0 |
| | (P content wt %) | (0.09) | (0.05) | (0.05) | (0.08) | (0.09) | (0.09) | (0.05) | (0.09) |
| | Pric. $C_{12}$-ZnDTP | — | — | 0.9 | 0.18 | — | — | — | — |
| | (P content wt %) | — | — | (0.05) | (0.01) | — | — | — | — |
| | Ca sulfonate ($C_{16-20}$) (TBN300) | 1.5 | 1.5 | 1.5 | 1.5 | 1.5 | 1.5 | 1.5 | 1.5 |
| | Ca salicylate ($C_{16-20}$) (TBN70) | 2.5 | 2.5 | 2.5 | 2.5 | — | 2.5 | — | 2.5 |
| | Ca salicylate ($C_{16-20}$) (TBN10) | — | — | — | — | 2.5 | — | 2.5 | — |
| | $C_8$-MoDTC (Mo = 500 ppm) | — | — | — | — | — | 1.0 | 1.0 | — |
| | $C_{18}$-MoDTC (Mo = 500 ppm) | 1.0 | 1.0 | 1.0 | 1.0 | 1.0 | — | — | 1.0 |
| Total base number of composition | | 6 | 6 | 6 | 6 | 5 | 6 | 5 | 6 |
| Evaluation | coefficient of friction (μ) | 0.040 | 0.033 | 0.039 | 0.036 | 0.039 | 0.029 | 0.027 | 0.030 |
| | wear track diameter (mm) | 0.51 | 0.53 | 0.54 | 0.50 | 0.48 | 0.49 | 0.52 | 0.46 |

TABLE 1-2

| | | Comparative Example 1 | Comparative Example 2 | Comparative Example 3 | Comparative Example 4 | Comparative Example 5 |
|---|---|---|---|---|---|---|
| Component (wt %) | Base Oil 150N-1 | balance | balance | balance | — | — |
| | Base Oil 150N-2 | — | — | — | balance | balance |
| | Sec. $C_3C_6$-ZnDTP | 1.0 | 1.0 | 0.3 | 1.0 | 0.3 |
| | (P content wt %) | (0.09) | (0.09) | (0.025) | (0.09) | (0.025) |
| | Pri. $C_{12}$-ZnDTP | — | — | 1.2 | — | 1.2 |
| | (P content wt %) | — | — | (0.066) | — | (0.066) |
| | Ca sulfonate ($C_{16-20}$) (TBN300) | 1.0 | 1.0 | 1.0 | 1.0 | 1.0 |
| | Ca salicylate ($C_{16-20}$) (TBN70) | 3.0 | 3.0 | — | 3.0 | 3.0 |
| | Ca salicylate ($C_{16-20}$) (TBN10) | — | — | 3.0 | — | — |
| | $C_8$-MoDTC (Mo = 500 ppm) | 1.0 | — | — | — | 1.0 |
| | $C_{18}$-MoDTC (Mo = 500 ppm) | — | — | 1.0 | — | — |
| Total base number of composition | | 5 | 5 | 3 | 5 | 5 |

TABLE 1-2-continued

| | | | | | | |
|---|---|---|---|---|---|---|
| Evaluation | coefficient of friction (μ) | 0.040 | 0.098 | 0.043 | 0.093 | 0.056 |
| | wear track diameter (mm) | 0.65 | 0.73 | 0.74 | 0.70 | 0.71 |

| | | Comparative Example 6 | Comparative Example 7 | Comparative Example 8 | Comparative Example 9 | Comparative Example 10 |
|---|---|---|---|---|---|---|
| Component (wt %) | Base 150N-1 | balance | balance | balance | balance | balance |
| | Oil 150N-2 | — | — | — | — | — |
| | Sec. $C_3/C_6$-ZnDTP | 0.73 | 1.0 | 1.67 | 0.11 | 1.0 |
| | (P content wt %) | (0.066) | (0.09) | (0.15) | (0.01) | (0.09) |
| | Pri. $C_{12}$-ZnDTP | 0.45 | — | — | 1.45 | — |
| | (P content wt %) | (0.025) | — | — | (0.08) | — |
| | Ca sulfonate ($C_{16-20}$) (TBN300) | 1.0 | 3.5 | 1.0 | 1.0 | 1.0 |
| | Ca salicylate ($C_{16-20}$) (TBN70) | 3.0 | 2.0 | 3.0 | 3.0 | 0.1 |
| | Ca salicylate ($C_{16-20}$) (TBN10) | — | — | — | — | — |
| | $C_8$-MoDTC (Mo = 500 ppm) | 1.0 | 1.0 | 1.0 | 1.0 | 1.0 |
| | $C_{18}$-MoDTC (Mo = 500 ppm) | — | — | — | — | — |
| Total base number of composition | | 5 | 12 | 5 | 5 | 3 |
| Evaluation | coefficient of friction (μ) | 0.057 | 0.078 | 0.055 | 0.047 | 0.055 |
| | wear track diameter (mm) | 0.63 | 0.70 | 0.57 | 0.79 | 0.61 |

As can be seen from a comparison of the data in Table 1-1 vs. Table 1-2, the oil composition according to the invention provides significantly improved coefficient of function, wear track diameter or both over the comparative composition set forth in Table 1-2.

The lubricating oil composition of the present invention has excellent antiwear properties and also excellent friction reducing properties, and is suitable for use as a lubricating oil for, for example, internal combustion engines, automatic transmissions, suspensions and power steering wheels, particularly as a lubricating oil for internal combustion engines.

We claim:

1. A lubricating oil composition comprising a base oil containing (A) 0.04 to 0.12% by weight in terms of phosphorus, based on the whole composition, of a zinc dialkyl dithiophosphate containing 50 to 100% by weight in terms of phosphorus, based on the total phosphorus content, of a zinc dialkyl dithiophosphate having secondary alkyl groups and 50 to 0% by weight in terms of phosphorus, based on the total phosphorus content, of a zinc dialkyl dithiophosphate having primary alkyl groups, (B) 1.0 to 3.0% by weight of a calcium sulfonate and 0.3 to 2.5% by weight of a calcium salicylate, and (C) 50 to 2000 ppm in terms of molybdenum of a sulfurized oxymolybdenum dithiocarbamate containing at least one hydrocarbyl group having 8 to 23 carbon atoms, wherein the oil composition is characterized by having a total base number of 2 to 13.

2. The oil composition of claim 1, wherein the base oil is a hydrocracked oil and/or a wax isomerized oil containing 3.0% by weight or below of an aromatic component and having a sulfur content of 50 ppm or below and a nitrogen content of 50 ppm or below.

3. The oil composition of claim 1, wherein the zinc dialkyl dithiophosphate having secondary alkyl groups has the general formula:

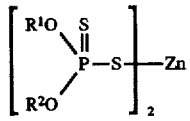

[1]

wherein $R^1$ and $R^2$ are each independently a secondary alkyl group having 3 to 25 carbon atoms.

4. The oil composition of claim 1, wherein the zinc dialkyldithiophosphate having primary alkyl groups has the formula:

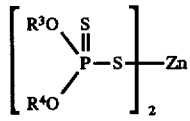

[2]

wherein $R^3$ and $R^4$ are each independently a primary alkyl group having 8 to 25 carbon atoms.

5. The oil composition of claim 1, wherein the calcium salicylate has the formula:

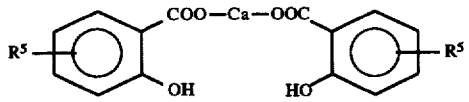

[3]

wherein $R^5$ is a linear, branched or cyclic alkyl group having 8 to 23 carbon atoms.

6. The oil composition of claim 1, wherein the sulfurized oxymolybdenum dithiocarbamate has the formula:

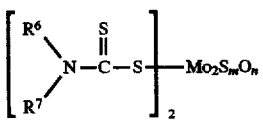

[4]

where $R^6$ and $R^7$ are each independently a hydrocarbyl group having 8 to 23 carbon atoms and the sum of m+n is 4.

* * * * *